United States Patent [19]

Casasent

[11] Patent Number: 4,641,273

[45] Date of Patent: Feb. 3, 1987

[54] GENERAL TIME, SPACE AND FREQUENCY MULTIPLEXED ACOUSTO-OPTIC CORRELATOR

[75] Inventor: David Casasent, Pittsburgh, Pa.

[73] Assignee: Teledyne Industries, Inc., Northridge, Calif.

[21] Appl. No.: 775,647

[22] Filed: Sep. 13, 1985

Related U.S. Application Data

[63] Continuation-in-part of Ser. No. 712,555, Mar. 15, 1985, and Ser. No. 712,194, Mar. 15, 1985.

[51] Int. Cl.[4] ..... G06G 9/00

[52] U.S. Cl. ..... 364/822; 364/819; 364/821; 350/358

[58] Field of Search ..... 364/819–822, 364/807, 829–830, 837, 713, 728, 604; 350/358, 96.11–96.16, 162.12, 162.13, 162.14

[56] References Cited

U.S. PATENT DOCUMENTS

| | | | |
|---|---|---|---|
| 3,802,762 | 4/1974 | Kiemle | 364/822 X |
| 4,124,280 | 11/1978 | Berg et al. | 350/358 |
| 4,225,938 | 9/1980 | Turpin | 364/822 |
| 4,440,472 | 4/1984 | Cohen | 350/162.12 |
| 4,468,084 | 8/1984 | Hutcheson et al. | 350/96.11 |
| 4,468,093 | 8/1984 | Brown | 350/162.12 |
| 4,519,046 | 5/1985 | Cole | 364/822 |
| 4,531,195 | 7/1985 | Lee | 364/822 |
| 4,558,925 | 12/1985 | Casseday et al. | 350/358 |
| 4,566,760 | 1/1986 | Abramovitz et al. | 350/358 |

*Primary Examiner*—Gary V. Harkcom

*Attorney, Agent, or Firm*—Blakely, Sokoloff, Taylor & Zafman

[57] ABSTRACT

Time, space and frequency multiplexed time integrating acousto-optic correlators and exemplary uses thereof. The correlators utilize a plurality of radio frequency (RF) modulators, each operating at the same or a different RF frequency to provide excitations to an acousto-optic cell representing the sum of the outputs of the modulators. A corresponding plurality of detectors are positioned so that light from the acousto-optic cells corresponding to the correlation output of various pairs of the RF modulators is incident to a respective one of the detectors. Uses for the correlators include demodulation and synchronization applications.

7 Claims, 4 Drawing Figures

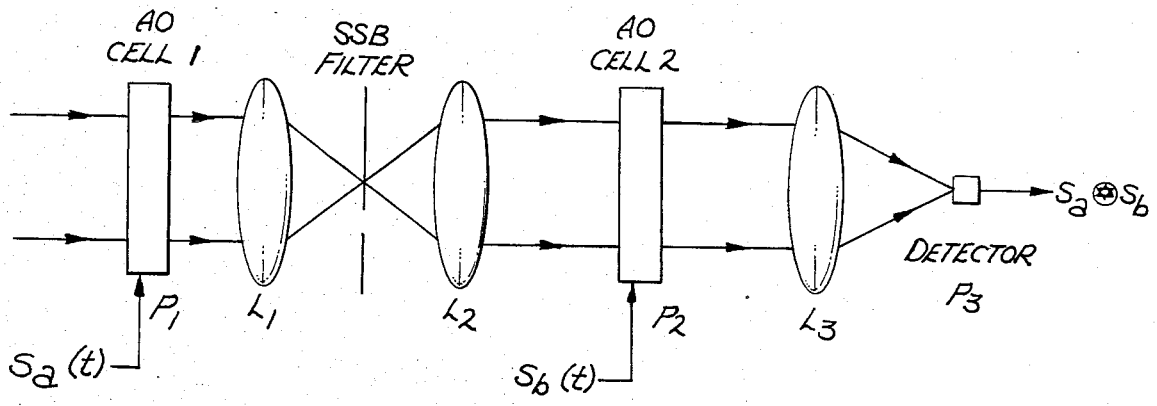
Fig. 1
(PRIOR ART)
Fig. 2
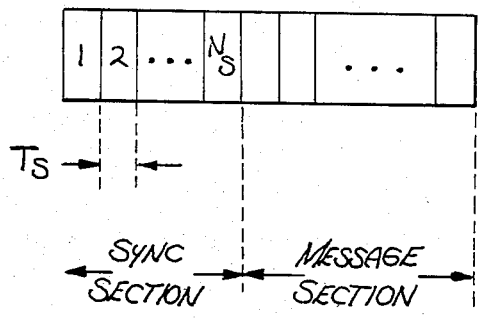

Fig. 3
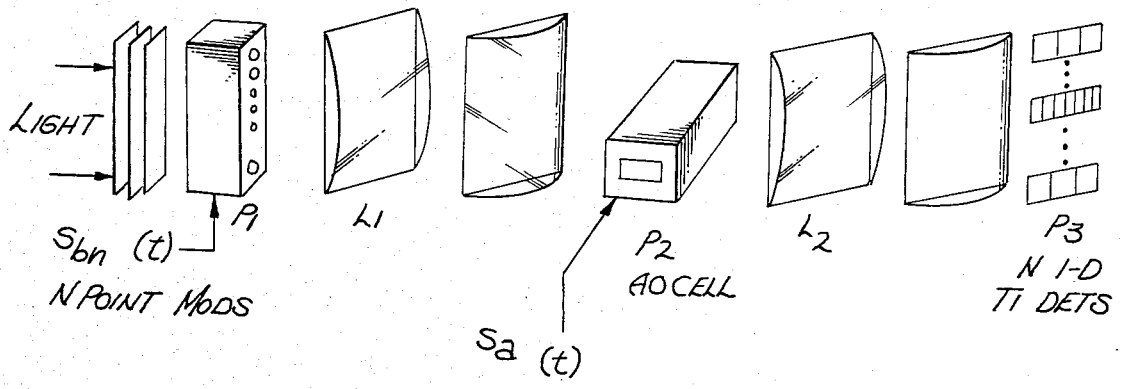
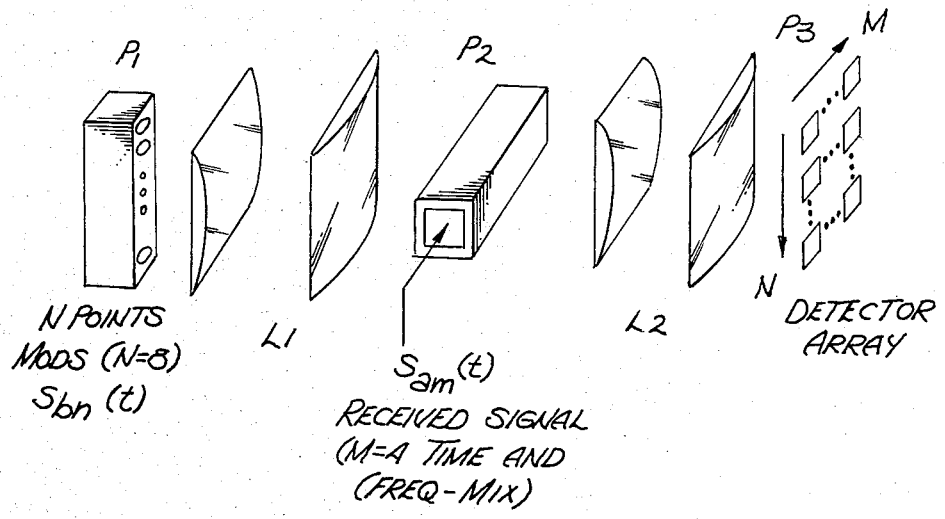
Fig. 4

GENERAL TIME, SPACE AND FREQUENCY MULTIPLEXED ACOUSTO-OPTIC CORRELATOR

This Application is a continuation-in-part of application Ser. No. 712,555, filed Mar. 15, 1985 and application Ser. No. 712,194, filed Mar. 15, 1985 and assigned to the Assignee in the present invention.

BACKGROUND OF THE INVENTION

1. Field of the Invention

The present invention relates to the field of acousto-optic devices and acousto-optic signal processing.

2. Prior Art

Acousto-Optic devices are well-known and widely used light modulators, being generally described in the literature, including *Proc. IEEE, Special Issue on Acousto-Optics,* Vol. 69, Jan. 1981 and *Acousto-Optic Signal Processing: Theory and Implementation,* Ed. N. J. Berg and J. N. Lee, Marcel Dekker, Inc., New York, 1983. An input electrical signal s(t) to such a device is converted to a sound field by an input transducer. This wave then travels the length of the crystal. An absorber at the far end of the device causes the wave to terminate with no reflections. The input electrical signal is present on a carrier as $s_1(t)=s(t)\cos\omega_c t$ or $s_2(t)=[B+s(t)]\cos\omega_c t$, where s(t) is a zero-mean signal and B is a bias. When illuminated with light, the cell diffracts the input light at angles proportional to $n\omega_c$. These waves are as diffracted orders and the wave $\propto\pm\omega_c$ as the first-order.

As the sound field travels the length of the cell, the sound field s(x,t) in the cell varies in space x and time t. Depending on the Acousto-Optic cell and the input signal $s_1(t)$ or $s_2(t)$, the amplitude or intensity of the first-order wave can be made proportional to s(t) or B+s(t) respectively. For amplitude modulation, the input electrical signal is s(t) cos $\omega_c t$ and the amplitude of the first-order wave is $$A_1(t,x)=e^{j\omega_L t}jA_{in}Ks(t-x/v)e^{j\omega c(t-x/v)} \quad (1)$$

i.e. the amplitude is proportional to s(t−x/v)

$$A_1(t,x)\propto s(t-x/v), \quad (2)$$

where K is a constant, $A_{in}$ is the amplitude of the input light wave and $\omega_L$ is its frequency, and v is the velocity of sound in the Acousto-Optic material. For intensity modulation, the input electrical signal is [B+s(t)] cos $\omega_c t$ and the intensity of the first-order wave is $$I(t,x)=KI_{in}[B+s(t-x/v)], \quad (3)$$

where K is a constant and $I_{in}=A_{in}^2$. Thus, except for a constant bias, the intensity is proportional to s(t−x/v), $$I(t,x)\propto s(t-x/v). \quad (4)$$

By a simple change of variables, we can write (2) and (4) as s(x−vt). This latter representation is more appropriate to describe a space integrating Acousto-Optic processor.

The classic time-integrating acousto-optic correlator of FIG. 1 is well-known and described in detail elsewhere, including the two references previously referred to and in R. A. Sprague and C. L. Koliopoulous, "Time Integrating Acousto-Optic Correlator", *Applied Optics,* Volume 15, pp. 89–92, January 1976; and P. Kellman, "Time Integrating Optical Processors", in *Optical Processing Systems,* W. Rhodes, ed. (Proc. SPIE, Vol. 185, 1979), pp. 130, 1979. Ignoring Bragg or Raman-Nath mode, amplitude or intensity modulation, any bias and $\omega_c$ carrier, and single-sideband filtering (described in the foregoing references), the operation of the system can easily be described. The system of FIG. 1 consists of a point modulator fed with a signal $s_b(t)$. Its output is expanded (by lens $L_1$) to uniformly illuminate an acousto-optic cell at $P_2$. The light distribution incident on $P_2$ is thus $s_b(t)$, varying in time and being uniform in space. With $s_2(t)$ fed to the acousto-optic cell, its transmittance is $s_a(t-\tau)$, where $\tau=x/v$ as in (2) or (4). The light leaving $P_2$ is now $s_b(t)s_a(t-\tau)$. Lenses $L_2$ image $P_2$ onto $P_3$ (and SSB filters the result). Since any bias and the $\omega_c$ carrier have been ignored, the pattern leaving $P_2$ and the pattern incident on $P_3$ are the same. The detector at $P_3$ time integrates the incident pattern and the $P_3$ output obtained is $$R(\tau)=\int_{s_b}(t)s_a(t-\tau)dt=s_b\circledast s_a, \quad (5)$$

i.e the correlation (symbol ⊛ ) of $s_a$ and $s_b$ is displayed as a function of space ($\tau\propto x$) at $P_3$.

The time integrating correlator is advantageous when $T_S>T_A$ and $TBWP_S>TBWP_A$, where $T_S$ is the signal duration, $T_A$ is the acousto-optic cell aperture time, $TBWP_S$ is the signal time-bandwidth product and $TBWP_A$ is the acousto-optic cell time bandwidth product. The processor of FIG. 1 can thus provide the correlation output for a very long signal, with the integration time $T_I$ of the detector determining the $T_S=T_I$ value used. If detector dynamic range is exceeded, the contents of the detector are dumped and stored (after some $T_I'>T_S$) and a new integration is begun. By noncoherently adding the R() outputs for separate $T_I'$, the full $T_I=T_S$ integration is achieved (at a loss of about 3 dB in processing gain due to the noncoherent summation). The time integrating correlator can however only search a limited time delay between signals $T_D(-T_A/2<T_D<T_A/2)$ set by $T_A$ of the acousto-optic cell, i.e., $T_D<T_A$.

BRIEF SUMMARY OF THE INVENTION

Time, space and frequency multiplexed time integrating acousto-optic correlators and exemplary uses thereof are disclosed. The correlators utilize a plurality of RF modulators, each operating at the same or a different RF frequency to provide excitations to an acousto-optic cell representing the sum of the outputs of the modulators. A corresponding plurality of detectors are positioned so that light from the acousto-optic cells corresponding to the correlation output of various pairs of the RF modulators is incident to a respective one of the detectors. Uses for the disclosed correlators include demodulation and synchronization applications.

BRIEF DESCRIPTION OF THE DRAWINGS

FIG. 1 is a block diagram of a prior art acousto-optic correlator.

FIG. 2 is an illustration of a typical communication signal format.

FIG. 3 is a schematic illustration of a basic time and space multiplexed time-integrating acousto-optic processor architecture.

FIG. 4 is a schematic illustration of a general purpose time, space and frequency multiplexed time integrating acousto-optic processor architecture.

DETAILED DESCRIPTION OF THE INVENTION

In the first parent application, the use of time delay reference, two-cycle coarse/fine synchronization, and multiple signal demodulation using space-multiplexing are detailed, as shall be seen. In the first application space multiplexing with time integration was detailed, but no frequency-multiplexing was discussed. In the second parent application, frequency multiplexing without space multiplexing was discussed for synchronization (but not for two cycle coarse/fine synchronization) and a frequency multiplexed time integrating system (with no space multiplexing) was discussed only for multiple signal demodulation). The present invention extends the processing architectures disclosed in application 1 and the frequency-multiplexing general concept in application 2 to provide significantly better systems by combining time, space and frequency multiplexing in time integrated acousto-optical correlations.

In accordance with the parent application, in the following description, the notation in Table I is used For the particular case when $$T_S > T_A \text{ and } TBWP_S > TBWP_A, \quad (6)$$

a time integrating (TI) correlator such as in FIG. 1 is required.

The TI correlator of FIG. 1 allows a long signal (with $T_S >> T_A$ and $TBWP_S >> TBWP_A$) to be processed. However, the correlation displayed is only of extent $T_A$. Thus, this correlator can only search a delay $-T_A/2 \leqq T_D \leqq T_A/2$ or a delay $T_D = T_A$.

The present invention comprises a new time, space and frequency-multiplexed acousto-optic processor preferable to those detailed before because of its ease of fabrication. This is achieved by the use of input space multiplexing (Application 1) in addition to frequency-multiplexing (Application 2). The basic concepts of coarse/fine synchronization (application 1) and multichannel demodulation by frequency multiplexing (application 2) are employed in the present system. A major aspect of the present invention is the architecture and its basic concepts, together with its use for general communication applications. This new proposed processor allows more practical embodiments of the earlier concepts. In the following description a general communication signal is described to define the problem in general terms. Then two new time integrating acousto-optic architectures using input space multiplexing and a frequency-multiplexed acousto-optic cell are described, including details of their synchronization and demodulation use in general terms. Since the use and preference of the present system is best conveyed by numeric examples, two such case studies are then provided.

The general problem to which the present invention is directed, may be defined by considering various existing communication scenarios and associated synchronization and demodulation requirements. To describe these in the most general manner we consider the generic signal of FIG. 2. This consists of a synchronization section with $N_S$ symbols and a message section with various symbol sections, each containing one of $N_M$ symbol codes. Each symbol is of duration $T_S$ and contains one of $N_M$ codes, each containing a message word of $N_P$ bits. PN codes with MSK modulation and in addition Walsh function codes are one very popular coding method for such use. It is assumed that one long pseudorandom noise (PN) code underlies the entire signal and that minimum shift keying (MSK) modulation is present on the signal. This modulation significantly reduces the modulation bandwidth requirements from twice the signal bandwidth to 1.2 times the signal bandwidth. Table 1 summarizes the notation and provides numerical values for use in the later examples. The acousto-optic cell notation used is included here for completeness. Error correction is easily included in the codes noted with no loss of generality in the present discussion.

TABLE 1

Notation and Numerical Values Used

| SYMBOL | PARAMETER | NUMERICAL VALUES Case A | Case B |
|---|---|---|---|
| $T_S$ | Symbol duration | 5 μsec | 10 μsec |
| $N_S$ | No. symbols in sync section | 50 | 9 |
| $N_M$ | No. of symbol codes | 32 | 16 |
| $N_P$ | No. of PN code bits per $T_S$ | 32 | 256 |
| $BW_S$ | Signal bandwidth $T_S/N_P$ | 6.4 MHz | 25.6 MHz |
| 1.2 $BW_S$ | Modulation bandwidth | 7.7 MHz | 30 MHz |
| T | Signal duration | — | — |
| TBWP | Time bandwidth product | — | — |
| $TBWP_S$ | Signal TBWP = (T)$BW_S$ | — | — |
| $T_A$ | Aperture time of AO cell | 12 μsec | 12 μsec |
| $BW_A$ | BW of AO cell | 60 MHz | 60 MHz |
| $TBWP_A$ | $TBWP_A = T_A BW_A$ of AO cell | 720 | 720 |
| $T_I$ | Integration time | — | — |
| $T_D$ | Delay Between $s_a$ and $s_b$ | — | — |
| $s_a$ | Received Signal | — | — |
| $s_b$ | Reference Signal | — | — |
| t | x/v = Delay variable in Cell | — | — |

From this general signal, the synchronization requirements of a general communications system can be defined. We require the correlation of a signal of duration $T = N_S T_S$, bandwidth $BW_S = N_P/T_S$ and signal time bandwidth product $TBWP_S = (T)BW_S$ with a range search delay $T_D = \infty$ (in general). In practice, some range gating bounds can be assumed, but in general $T_D > T_S$ is required and in this case our processor is capable of an infinite range delay search because each reference signal of duration $T_S$ is cyclically repeated. The Walsh function or other message code sequence in the sync section is known in advance, as is the PN code in the sync section. Thus, the entire sync section can be viewed as one long signal as assumed above.

Once the receiver is in synchronization, demodulation of each symbol in the message section is required. To achieve this requires the correlation of the input with $N_M$ reference signals with $T_S$, $BW_S$ and $TBWP_S$, but with no delay requirement (i.e., $T_D = 0$), since the signal is in synchronization. The multi-channel correlation output ($N_M$ channels) with a peak defines the message word transmitted during that $T_S$ portion of the signal.

The duration of the sync section of typical communication signals exceeds the realistic aperture time $T_A$ limits of acousto-optic cells. Thus, a space integrating correlator is not useful, since it is limited to processing signals of duration $T_A$. Thus, only time integrating acousto-optic correlator architectures are considered. It was earlier described how to feed M frequency multiplexed reference signals to an acousto-optic cell and how to obtain the correlation of a received signal with these M reference signals. Applications of this technique for synchronization and multi-code demodulation were also detailed. This prior technique and the associated system realization are limited to modest values for M and in practice do not easily allow full sampling of each of the M correlation outputs. There is no need to review the prior methods since the present discussion and realization are preferable and different from the prior ones. The basic concept of frequency-multiplexing (application 2) involves placing several signals (each on a different carrier frequency) in one device. Which signals and frequencies are employed and how frequency-multiplexing is used is different for each architecture. Introduced herein are space and frequency multiplexed architectures and their extensions that acheve synchronization and demodulation in a much preferable manner. (The details of amplitude and intensity mode acousto-optic cell operation and single sideband filtering are omitted for simplicity, as is customary.)

FIG. 3 shows a space multiplexed time integrating acousto-optic correlator with N point modulators at plane $P_1$ fed with N signals $s_{bn}(t)$. The light from point modulator n is $s_{bn}(t)$. These outputs are collimated horizontally (to uniformly illuminate an acousto-optic cell at $P_2$ with each signal) and focused vertically at $P_2$ (with each $s_{bn}$ (t) incident on $P_2$ at a different angle vertically, thus not violating the Bragg condition for the acousto-optic cell). A pair of cylindrical lenses $L_1$ achieves the required $P_1$ to $P_2$ imaging and focusing. Lenses $L_2$ image $P_2$ horizontally onto $P_3$ and focus each of the N light waves leaving $P_2$ onto a different vertical location in $P_3$. Plane $P_3$ contains N one dimensional linear time integrating detector arrays stacked vertically. The $P_3$ outputs are the correlation of the input signals $s_a(t)$ to $P_2$ with the N input references $s_{bn}$ at $P_1$. This new architecture is a very attractive new multi-channel correlator with each correlation output able to be easily fully sampled and with N larger than M in the prior systems (application 2).

We next consider a new variation in the $P_3$ detection system. All detector arrays cover the same total physical length horizontally. However, the central detector array in $P_3$ is fully populated (with $TBWP_A$ detector elements) with the other detector arrays having fewer (e.g. three) detector elements. The reason for these $P_3$ detector configurations is discussed below.

Consider the use of the system of FIG. 3 to process the general communication signal of FIG. 2. Considering synchronization first, and only one channel in FIG. 3, the received signal $s_a(t)$ is fed to the acousto-optic cell and the reference signal $s_b(t)$ is fed to the central point modulator at $P_1$ of FIG. 3. The central detector array at $P_3$ then contains the correlation of these two signals.

$$s_b \circledast s_a = \int_{s_b} (t)s_a(t-\tau)dt = R(\tau) \tag{7}$$

Since $$T_1 = T = N_s T_s > T_A, \tag{8}$$

A time integrating architecture is required. With a time integrating system, the time delay $T_D$ allowed between the received and reference signals must satisfy $$T_D \leqq T_A \tag{9}$$

if the full processing gain is to be achieved. The application considered requires $T_D > T_A$, and in general $T_D = \infty$.

To achieve this the full system of FIG. 3 is employed. N point modulators at $P_1$ are fed with N delayed versions of the reference signal, with a delay $nT_A$ for input $P_1$ point modulator n. Thus, $$s_{ba}(t) = s_b(t - nT_A) \tag{10}$$

Each input signal is cyclically repeated. Thus, during any time that the received signal is in the cell, the starting bit in the synchronization code will be present from one of the $P_1$ point modulators. Each of the N correlations performed by this system thus searches a different $T_A$ delay, and the entire system searches $NT_A$ of delay. If $$NT_A \geqq \mathrm{Min}[T = N_s T_s \text{ or } T_D] \tag{11}$$

the system can search an infinite range delay with the full processing gain (PG) (if fully populated $P_3$ detectors are used) of a signal of duration T and time bandwidth product $TBWP_S$.

Several variations of this system are possible. If the $P_3$ correlation is not present on a spatial carrier, then one can employ fewer detectors such as only three detectors covering each of the correlation patterns at $P_3$. For a wide variety of signals, this allows adequate probability of detection $P_D$. This will reduce PG during coarse sync but the full PG will occur upon fine sync (if the central $P_3$ detector array is fully populated). In this case, the correlation output (from the N correlations produced) with a peak above threshold defines coarse synchronization within $T_A$ (since each correlation plane is quantized to a delay of approximately $T_A$). Once coarse synchronization has been achieved, the reference signal is aligned within $T_A$, this one reference signal is fed to the central point modulator at $P_1$ and the received signal delayed by the proper increment of $T_A$ is fed to the acousto-optic cell. The correlation of these signals then appears on the fully populated central detector array at $P_3$ and thus provides fine synchronization within one bit time with the full processing gain and probability of detection. This new coarse/fine detection system significantly reduces the $P_3$ detection plane requirements and the associated electronic post-processing. This is achieved at the expense of a constant time-lag of T in the output processed data. Since the system is fully pipelined, this represents no problem.

Next, consider demodulation of the communication signal on this processor. For this, simply feed the $N_M$ codes to the $P_1$ modulators (one to each), feed the received message signal to $P_2$ and time integrate at $P_3$ for $T_S$. Each $T_S$, the central detector with the largest peak value defines the message word present in that $T_S$ symbol time. In this case, only the central detector in each correlation plane need be investigated (since the system is in synchronization). If the detector peak varies from the central detector element, then the use of three detectors per correlation plane easily allows one to detect this synchronization drift and to resynchronize the system. Many codes suffer negligible loss in probability of detection when coarse correlation plane sampling as employed above is performed.

In general, the bit rate of communication signals is low, e.g., 256 chips every 10 μsec or 25.6 chips/μsec. A typical acousto-optic cell with $T_A = 10$ μsec has a $TBWP_A = 1000$ to 2000. Thus, typical communication data rates are a factor of 10 below what an acousto-optic cell can accommodate (e.g., $2000/T_A = 200$ chips/us can be supported by a typical acousto-optic cell). To more fully utilize typical acousto-optic cell specifications, frequency multiplexing of the input signals to the acousto-optic cell at $P_2$ of FIG. 3 can be employed. In this case, M frequency multiplexed signals $s_{am}(t)$ are fed simultaneously to the acousto-optic cell. The cell and signal bandwidth limit M to $$M \leqq BW_A/1.2BW_s = [TBWP_A/1.2TBWP_s](T/T_A), \quad (12)$$

where the 1.2 factor arises from the modulation bandwidth using MSK modulation. The concept of frequency-multiplexing was first introdcuced by J. Cohen ["Frequency Division Multiplexing Optical Processors", Proc. SPIE, 341, pp 172–185 (1982)] and applied to correlation applications with a new more efficient architecture by Casasent [D. Casasent "Frequency-multiplexed acousto-optic architectures and applications" Mar. 15, 1985, Applied Optics, Vol. 24, pages 856–858]. The present architecture is a new one in which frequency multiplexing is much more practical and efficient.

Such a processor is shown in FIG. 4. In this case, M frequency multiplexed signals $s_{am}(t)$ are fed to the acousto-optic cell at $P_2$. In this system, the N input signals at $P_1$ are correlated with each of the M signals at $P_2$ and a two dimensional detector array exists at $P_3$. The correlations with the N signals $s_{bn}(t)$ appear vertically on different rows in $P_3$ and the correlations with the M signals $s_{am}(t)$ appear horizontally on different columns in $P_3$. Thus, the bottom row in $P_3$ contains the correlations of $s_{b1}(t)$ with the M references $s_{am}(t)$, each correlation appearing in a different spatial location horizontally in $P_3$. The first column in $P_3$ contains the correlation of $s_{a1}(t)$ with all N signals $s_{bn}(t)$, etc.

In situations where the number of point modulators N in FIG. 3 becomes prohibitive, the system of FIG. 4 is preferable and necessary. Now consider the use of FIG. 4 for synchronization when N in equation 11 is large. In this case, we feed the $P_1$ inputs as before with N delayed reference signals with delays $nT_A$ as in equation 10. The $P_1$ references thus achieve a continuous delay search of $NT_A$ as before. To the acousto-optic cell at $P_2$, M delayed versions of the received signal with delays $NT_A$, $2NT_A$, etc. are fed, i.e., $$s_{am}(t) = s_a(t - mNT_A) \quad (13)$$

Each of these signals is frequency multiplexed and present simultaneously in $P_2$. The $P_1$ inputs continuously cover a fine delay $NT_A$ and the delays in the received signal at $P_2$ cover a delay $MNT_A$ in coarse $NT_A$ steps. The correlation of each $P_2$ input with all $s_{bn}(t)$ searches a different delay $NT_A$. Thus a full $$T_D = MNT_A \quad (14)$$

delay search is achieved and the horizontal and vertical axes in $P_3$ correspond to coarse and fine delay axes.

This is a new range delay sync information output format (from those in prior space or frequency-multiplexed works) with coarse and fine delay outputs on two axes. This system also achieves a longer $T_D$ search (by a factor of N, due to space multiplexing) than do prior frequency-multiplexed systems. Coarse detector sampling can be employed to reduce the output plane processing requirement (as discussed in conjunction with FIG. 3) and/or two coarse and fine synchronization cycles can be used as before with one fully populated linear detector array. In many cases, the number of detectors required for a fully populated $P_3$ plane is not excessive, as shall be subsequently seen. In this case, an infinite range delay search requires $$MNT_A \geqq MIN[T_D \text{ or } T_S]. \quad (15)$$

Thus, the number of $P_1$ point modulators can be reduced at a factor of M and the bandwidth requirements for the acousto-optic cell increased by a factor M. In general, this approach more fully utilizes the available acousto-optic cell parameters for typical communication signal parameters.

For demodulation, a similar time multiplexing can be employed to handle the correlation of each symbol packet with a large number of reference codes $N_M$. The message symbols are referred to by their time slots $T_{S1}$, $T_{S2}$, etc. (with the signals in each denoted by S1, S2, etc.) and the reference codes are referred to by $C_1$–$C_{4N}$ (assuming 4N codes). The demodulation procedure using FIG. 4 is most easily described for a specific example. By way of example, select N=8 point modulators at $P_1$ and M=4 multiplexed frequencies at $P_2$. In this case, the received signal message is delayed by $T_S$, $2T_S$ and $3T_S$. These 4 received messages are frequency multiplexed in each of four successive $T_S$ time slots in a moving window fashion. The contents of the acousto-optic cell on the multiplexed frequencies $f_n$ at different $nT_S$ instances are

| | $nT_S$ times | $1T_S$ | $2T_S$ | $3T_S$ | $4T_S$ | $5T_S$ | $6T_S$ | | (16) |
|---|---|---|---|---|---|---|---|---|---|
| $P_2$ INPUTS ($f$ – $mux'd$) | | | | | | | | | |
| | on freq. $f_1$ | $S1$ | $S1$ | $S1$ | $S1$ | $S2$ | $S3$ | | |
| | on freq. $f_2$ | | $S2$ | $S2$ | $S2$ | $S3$ | $S4$ | etc. | |
| | on freq. $f_3$ | | | $S3$ | $S3$ | $S4$ | $S5$ | | |
| | on freq. $f_4$ | | | | $S4$ | $S5$ | $S6$ | | |

From equation 16, it is seen that each signal is present in the cell for $4T_S$. During four successive $T_S$ times, the N inputs at $P_1$ are fed time sequentially with the codes as follows

| | | | | | | | | |
|---|---|---|---|---|---|---|---|---|
| $nT_S$ $nT_S$ times | $1T_S$ | $2T_S$ | $3T_S$ | $4T_S$ | $5T_S$ | $6T_S$ | | (17) |
| $P_1$ $P_1$ inputs (space-mixed) | $C_1$–$C_8$ | $C_9$–$C_{16}$ | $C_{17}$–$C_{24}$ | $C_{25}$–$C_{32}$ | $C_1$–$C_8$ | $C_9$–$C_{16}$ | etc. | |

With these input data arrangements, N=8 codes are correlated against M=4 successive symbol packs ($S_1$, $S_2$, etc.) and MN=32 correlations are performed each $T_S$. This is achieved with only 8 space multiplexed inputs at $P_1$. After $MT_S$, M message symbols have been correlated with MN references. This satisfies the requirements of the demodulation section of the general communications signal processor. This combined time, space and frequency multiplexed arrangement offers considerable reduction in the component requirements of the system without overly exceeding realistic acousto-optic cell specifications, and while retaining modest requirements for input (N), acousto-optic cell (M) and output (MN) parameters.

The full significance of the foregoing description can best be realized when a specific example is considered. Frequency guard bands are ignored for simplicity in the following discussion with no loss in generality concerning the points to be advanced. Consider the two signals defined in Table 1 and an acousto-optic cell described by $T_A=12$ μsec and $BW_A=60$ MHz. This corresponds to a modest $TBWP_A=720$. The objective is to demonstrate how the same basic processor of FIG. 4 can accommodate both signal A and signal B in Table 1 (on the same processor), despite the significant differences in these signals and their associated synchronization and demodulation requirements.

Consider signal B in Table 1 initially. Synchronization of this signal requires the correlation of a signal with $T=9(10)=90$ μsec, $BW_S=25.6$ MHz and $TBWP_S=9(256)=2304$, with $T_D=\infty$. To achieve this, the system of FIG. 3 is employed with $N \geqq T/T_A=90/12$ or $N=8$ point modulators at $P_1$. For synchronization a bandwidth for the point modulators and the acousto-optic cell of only 30 MHz (the extra 1.2 factor arises because of the MSK modulation) is required. For demodulation of signal B, 16 parallel correlations on signals with $T=T_S=10$ μsec, $BW_S=25.6$ MHz and $TBWP_S=256$ are required. It is desired to still employ only $N=8$ point modulators (rather than $N=16$, which would allow direct implementation on FIG. 3) and to use FIG. 4). Thus, consider the system of FIG. 4 with $M=2$ frequencies at $P_2$ and $N=8$ point modulators at $P_1$, with space and frequency multiplexing as detailed before. The required acousto-optical cell specifications are quite modest: $T_A=12$ μsec, $BW_A=60$ MHz and $TBWP_A=720$. The detector system for synchronization uses 7 detector arrays with 3 elements each and one with 256 elements (or 8 arrays with 256 elements in each). For demodulation, we require two columns of 8 detectors each. These are all quite modest and realistic requirements for all components.

For signal A in Table 1, synchronization requires a long integration time $T_I=5(50)=250$ μsec, with a signal $BW_S=6.4$ MHz. Using the same $T_A=12$ μsec and $N=8$ parameters as before, equation 15 only requires that $M>250/96$, or 3 multiplexing frequencies for sync. Demodulation with 32 correlations on different 32 bit codes requires 32 parallel correlators for signals with $T_S=5$ μsec and a modest $BW_S=6.4$ MHz and $TBWP_S=32$. This can be achieved with $N=8$ point modulators and four multiplexed frequencies, with time multiplexing of the inputs as detailed in equations 16 and 17. The acousto-optic cell requirements are again quite modest with $BW_A=4(1.2)6.4=30.8$ MHz, $TBWP_A=8(32)=256$ and $T_A=12$ μsec. The detector system for synchronization of this signal A requires 3 columns with 8 linear detector arrays in each column, with 3 detector elements in each of the $3(8)=24$ detector arrays and with one detector array with 32 elements. Alternatively 24 arrays of 32 detectors each can be arranged in $P_3$. This latter requirement is not excessive. For modulation, 4 columns with 8 detector arrays in each column and 3 detectors per array suffices.

In conclusion, a general purpose and flexible acousto-optic correlator employing time, space and frequency multiplexing has been described, and its use in processing several widely different communication signals detailed. This architecture and its applications has included several novel synchronization and demodulation signal processing techniques. These applications and system uses have been detailed in general terms and then quantified by numerical examples. The flexibility of the system described is very attractive. The basic system uses a fixed number of input point modulators to achieve space multiplexing. As the application demands, more frequency multiplexed signals and time multiplexing are then included. However, the basic optical system remains the same, and thus one system is capable of handling a large number of diverse communication signals. Such a system could include a beam splitter placed after the acousto-optic cell with different $L_2$ optics and different detection plane configurations for each application as desired. Also, while the implementations of FIGS. 3 and 4 using bulk acousto-optic devices are preferred, the methods of the present invention may also be practiced employing various other technologies, such as, by way of example, integrated optics and advanced digital correlators. Thus while preferrred embodiments and uses have been described in detail herein, it will be understood by those skilled in the art that various changes in form and detail may be made therein without departing from the spirit and scope of the invention.

I claim:

1. A space and frequency multiplexed, time integrating correlator comprising a plurality (N) of light sources distributed along a first direction, each for emitting light having an intensity or amplitude responsive to a respective one of a plurality of first electric signals applied thereto;

an acousto-optic cell extending in a second direction orthogonal to said first direction and having an input transducer for creating a sound field in said cell responsive to a second electric signal consisting of a plurality (M) frequency multiplexed signals applied thereto;

a first lens means between said plurality of light sources and said acousto-optic cell for substantially uniformly illuminating said acousto-optic cell with light from each of said light sources;

a plurality (NM) of time integrating light detection means equal in number to the number (N) of said light sources times the number (M) of said frequency multiplexed signals, each for providing a signal responsive to the light incident thereto, said light detection means being arranged in an N by M array of light detection means wherein N light detection means are distributed in each of M linear arrays along said first direction and M light detection means are distributed in each of N linear arrays along said second direction; and a second lens means between said acousto-optic cell and said plurality of light detection means to illuminate light detection means in each of said M linear arrays of N detectors with light originating from a respective one of said light sources, said second lens means also being a means for illuminating each of said M light detection means in each of said N linear arrays with light from said acousto-optic cell within a respective frequency range correponding to the frequency range of one of said frequency multiplexed signals, whereby each of said light detection means will provide a signal responsive to a respective first signal as correlated with a respective one of said frequency multiplexed signals.

2. The space and frequency multiplexed, time integrating correlator of claim 1 wherein each of said light detection means comprises a plurality of light detectors.

3. The space and frequency multiplexed, time integrating correlator of claim 2 wherein each said plurality of light detectors is a linear array of light detectors extending in said second direction.

4. The space and frequency multiplexed, time integrating correlator of claim 3 wherein each said plurality of light detectors comprises at least three detectors.

5. The space and frequency multiplexed, time integrating correlator of claim 4 wherein one of said plurality of light detectors comprises a number of detectors approximately equal to the bandwidth of each of the frequency multiplexed signals times the aperture time of the acousto-optic cell.

6. A method of synchronizing a reference signal with a received signal comprising the steps of (a) providing a space and frequency multiplexed, time integrating correlator comprising:

a plurality (N) of light sources distributed along a first direction, each for emitting light having an intensity or amplitude responsive to a respective one of a plurality of first electric signals applied thereto;

an acousto-optic cell extending in a second direction orthogonal to said first direction and having an input transducer for creating a sound field in said cell responsive to a second electric signal consisting of a plurality (M) frequency multiplexed signals applied thereto;

a first lens means between said plurality of light sources and said acousto-optic cell for substantially uniformly illuminating said acousto-optic cell with light from each of said light sources;

a plurality (NM) of time integrating light detection means equal in number to the number (N) of said light sources times the number (M) of said frequency multiplexed signals, each for providing a signal responsive to the light incident thereto, said light detection means being arranged in an N by M array of light detection means wherein N light detection means are distributed in each of M linear arrays along said first direction and M light detection means are distributed in each of N linear arrays along said second direction; and a second lens means between said acousto-optic cell and said plurality of light detection means to illuminate light detection means in each of said M linear arrays of N detectors with light originating from a respective one of said light sources, said second lens means also being a means for illuminating each of said M light detection means in each of said N linear arrays with light from said acousto-optic cell within a respective frequency range corresponding to the frequency range of one of said frequency multiplexed signals, whereby each of said light detection means will provide a signal responsive to a respective first signal as correlated with a respective one of said frequency multiplexed signals (b) coupling delayed versions $s_{bn}(t)$ of the reference signal $S_b(t)$ to each of the plurality (N) of the light sources, each having a relative delay $nT_A$, where n is the number of the respective light source and $T_A$ is the acousto-optic cell aperture time (c) coupling a plurality (M) of frequency multiplexed delayed versions of the received signal $S_{am}(t)$ to the input transducer of the acousto-optic cell, each having a relative delay $mNT_A$, where m is the number of the respective delayed signal, M is less than the bandwidth of the acousto-optic cell divided by 1.2 times the bandwidth of the signal, and $MNT_A$ exceeds the minimum of the received signal duration or the delay between the received signal and the reference signal.

7. A method of demodulating a receiving signal containing many symbol packets by correlating each symbol packet with a large number NM of reference codes, each symbol in a symbol packet having a duration $T_S$, comprising the steps of:

(a) providing a space and frequency multiplexed, time integrating correlator comprising:

a plurality (N) of light sources distributed along a first direction, each for emitting light having an intensity or amplitude responsive to a respective one of a plurality of first electric signals applied thereto;

an acousto-optic cell extending in a second direction orthogonal to said first direction and having an input transducer for creating a sound field in said cell responsive to a second electric signal consisting of a plurality (M) frequency multiplexed signals applied thereto;

a first lens means between said plurality of light sources and said acousto-optic cell for substantially uniformly illuminating said acousto-optic cell with light from each of said light sources;

a plurality (M) of time integrating light detection means equal in number to the number (N) of said light sources times the number (M) of said frequency multiplexed signals, each for providing a signal responsive to the light incident thereto, said light detection means being arranged in an N by M array of light detection means wherein N light detection means are distributed in each of M linear arrays along said first direction and M light detection means are distributed in each of N linear arrays along said second direction; and a second lens means between said acousto-optic cell and said plurality of light detection means to illuminate light detection means in each of said M linear arrays of N detectors with light originating from a respective one of said light sources, said second lens means also being a means for illuminating each of said M light detection means in each of said N linear arrays with light from said acousto-optic cell within a respective frequency range corresponding to the frequency range of one of said frequency multiplexed signals, whereby each of said light detection means will provide a signal responsive to a respective first signal as correlated with a respective one of said frequency multiplexed signals;

(b) coupling one of the reference codes to a respective one of the plurality (N) of light sources (c) coupling a plurality (M) of frequency multiplexed delayed versions of the received signal $S_a(t)$ to the input transducer of the acousto-optic cell, each having a relative delay $mT_S$, where m is the number of the respective delayed signal, and $T_S$ is the duration of a symbol.

* * * * *

UNITED STATES PATENT AND TRADEMARK OFFICE

CERTIFICATE OF CORRECTION

PATENT NO. : 4,641,273

DATED : 2/3/87

INVENTOR(S) : Casasent

It is certified that error appears in the above-identified patent and that said Letters Patent is hereby corrected as shown below:

| COLUMN | LINE | DESCRIPTION |
|---|---|---|
| 2 | 38 | delete "()" insert --(t)-- |
| 3 | 18 | delete ")" |

Signed and Sealed this

Twentieth Day of September, 1988

*Attest:*

DONALD J. QUIGG

*Attesting Officer*

*Commissioner of Patents and Trademarks*